US006332416B1

(12) United States Patent
Wohnhas et al.

(10) Patent No.: US 6,332,416 B1
(45) Date of Patent: Dec. 25, 2001

(54) SEWING MACHINE NEEDLE HAVING MEANS FOR IMPROVED LOOP FORMATION

(75) Inventors: Hans-Kurt Wohnhas, Albstadt; Bernd Hillenbrand, Albstadt-Truchtelfingen; Gerd Horn, Albstadt, all of (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 09/613,506

(22) Filed: Jul. 10, 2000

(30) Foreign Application Priority Data

Jul. 10, 1999 (DE) ..... 199 32 288

(51) Int. Cl.[7] ..... D05B 85/00
(52) U.S. Cl. ..... 112/222
(58) Field of Search ..... 112/222, 224; 223/102

(56) References Cited

U.S. PATENT DOCUMENTS

| | | | | |
|---|---|---|---|---|
| 3,523,510 | | 8/1970 | Mueller . | |
| 4,233,917 | | 11/1980 | Carnaby . | |
| 4,458,614 | | 7/1984 | Iwashita . | |
| 4,502,403 | | 3/1985 | Carnaby . | |
| 4,579,072 | * | 4/1986 | Koike et al. | 112/222 |
| 5,392,725 | * | 2/1995 | Takei et al. | 112/222 |

FOREIGN PATENT DOCUMENTS

| | | |
|---|---|---|
| 2 412 062 | 10/1974 | (DE) . |
| 28 34 738 | 7/1984 | (DE) . |
| 30 02 345 | 2/1986 | (DE) . |
| 0 187 925 | 7/1986 | (EP) . |

* cited by examiner

*Primary Examiner*—Ismael Izaguirre
(74) *Attorney, Agent, or Firm*—Venable; Gabor J. Kelemen

(57) ABSTRACT

A needle for introducing a thread into or through a fabric includes an elongated needle blade having a longitudinal axis; a needle point; and an eye traversing the needle blade at an acute angle to the longitudinal axis. The needle eye has an inlet and an outlet situated on opposite sides of the needle blade. The needle further has a protuberance formed on the needle blade. The protuberance adjoins the eye outlet and projects laterally away from the needle blade.

25 Claims, 4 Drawing Sheets

SEWING MACHINE NEEDLE HAVING MEANS FOR IMPROVED LOOP FORMATION

CROSS REFERENCE TO RELATED APPLICATION

This application claims the priority of German Application No. 199 32 288.0 filed Jul. 10, 1999, which is incorporated herein by reference.

BACKGROUND OF THE INVENTION

This invention relates to a needle, particularly for introducing a thread into the material to be sewn (generally referred to hereafter as "fabric") by means of a sewing machine During sewing of a fabric, an "upper" thread is repeatedly introduced into the fabric by means of a needle which has an eye adjacent the needle point. Each time the needle is withdrawn, a loop is formed which is caught by a loop gripper and a "lower" thread is pulled through the loop. As a result, a seam is obtained which is composed of the upper and lower threads. To be able to pull the lower thread through the loop, the loop is caught by the loop gripper and is enlarged for pulling it around a bobbin containing the lower thread. For this purpose first the loop gripper pulls on the upper thread which thereafter is withdrawn through the needle eye. Consequently, the upper thread passes through the needle eye several times, resulting in substantial stresses to which the thread is exposed.

Further, sewing methods are known where the upper thread is introduced into or through the fabric without holding firmly the thread and the produced loop by a gripper during withdrawal of the needle. If during such an operation a loop is reliably formed, the thread has to be held by friction between the itself and the fabric.

U.S. Pat. No. 3,523,510 discloses a tufting needle for the manufacture of tufted carpeting. The needle serves for introducing a pile yarn through a backing fabric and to form loops with the pile yarn. For this purpose, the tufting needle has an approximately cylindrical blade which ends in a point. In the vicinity of the needle point a funnel-shaped eye is formed which is inclined to the central axis of the needle at approximately 30°. An air channel provided in the tufting needle supplies pressurized air to the eye. Adjoining the eye on both oppositely located sides of the tufting needle shallow troughs are provided whose depth is less than the smallest diameter of the eye. Adjacent the eye the blade is cylindrical in the direction of its clamping location and is conical in the direction of the needle point. The loop formation is enhanced in such a needle by the effect of the pressurized air introduced into the eye. Other means for holding the thread loop are not disclosed in the above-noted U.S. Patent.

A further tufting needle is disclosed in Published European Application 187 925. The tufting needle disclosed therein has a tubular base body which is obliquely cut for forming a point. At the side opposite the oblique face the tubular base body is also open so that a thread running through the open inner space may exit at the obliquely arranged outlet surface of the tubular base body. The eye formed in this manner has an oval cross-sectional shape which changes along the eye because of a deformation imparted on the tubular base body. On that side of the tubular base body which is opposite its open side, the tubular base body is flattened so that a bay or hollow wedge is formed.

A further tufting needle is described in German Patent No. 2,834,738. The needle disclosed therein has a needle base body provided with a flat cross-sectional configuration which, according to one embodiment, extends essentially unchanged to the needle eye oriented transversely to the longitudinal axis of the needle and has lengthwise an oval shape. A trough leads to the eye; the trough is significantly shallower than the height of the thread. The length of the eye in this embodiment is approximately the same size as the mouth of the eye at the two opposite needle sides.

According to another embodiment disclosed in German Patent No. 2,834,738 a tufting needle has an approximately spoon-shaped head. A thread trough extending along the needle blade has a depth which is less than the thread thickness and substantially less than the width of the eye. The eye is oval and extends transversely through the tufting needle. On that side which is opposite the thread trough an outwardly bent portion is provided in the region of the eye and in an adjoining blade zone.

Similar tufting needles are shown in German Patent No. 3,002,345, as well as U.S. Pat. Nos. 4,233,917 and 4,502,403.

German Offenlegungsschrift (application published without examination) 2,412,062 discloses a sewing needle configured to cooperate with a thread gripper. The sewing needle serves to push the upper thread through the fabric, and the loop which is being formed is then held by the thread gripper and is enlarged. The sewing needle has a blade having a thread trough whose depth is slightly greater than the smallest diameter of the eye so that the thread runs entirely within the trough. The eye extends along an arcuate path transversely through the needle and flares in a funnel-shaped manner. The shape of the eye is oval in cross-section. A depressed face is located on that side of the eye which is remote from the needle point and which faces away from the thread trough and immediately adjoins the needle eye. The depressed face is provided for the hook or gripper which cooperates with the needle.

SUMMARY OF THE INVENTION

It is an object of the invention to provide a sewing needle having means for an improved loop formation.

This object and others to become apparent as the specification progresses, are accomplished by the invention, according to which, briefly stated, the needle for introducing a thread into a fabric includes an elongated needle blade having a longitudinal axis, a needle point and an eye traversing the needle blade at an acute angle to the longitudinal axis. The needle eye has an inlet and an outlet situated on opposite sides of the needle blade. The needle further has a protuberance formed on the needle blade. The protuberance adjoins the eye outlet and projects laterally away from the needle blade.

The needle according to the invention has a long eye which guides the thread in a highly satisfactory manner and further comprises a protuberance which adjoins the eye outlet and which serves for firmly clamping the thread in the fabric. The eye is formed by a preferably linear through passage which is inclined at an acute angle to the length dimension of the needle. Such a structure ensures a reduced friction imparted on the running through the eye thread by the eye as well as a highly satisfactory guidance of the thread.

By virtue of the protuberance provided on the needle back a pull-back of the thread through the needle eye and thus pulling together the thread loop produced by the needle during the penetration process are avoided. Thus, the needle according to the invention may produce a loop which, upon withdrawal of the needle, is preserved in its ideally complete configuration. The use of a gripper which would firmly hold the loop may thus be dispensed with. This permits the mere insertion of threads into thicker fabrics. Thus, for example several layers of material, such as carbon fiber mats may be fixed, stabilized or connected one to another. In such a case solely an upper thread is used. The thickness of the mats may be 40 mm or more and need not be uniform. This is the cases for example, in win or fuselage surfaces for air planes consisting of several layers. It is of significance in this conjunction that this kind of stabilization without a lower thread does not damage the carbon fiber mats and further, the height of the mat assembly is not affected by a knotting with a lower thread. This cannot be ensured in case of a conventional backstitch seam with upper thread and a lower thread knotted therewith. The layered material stabilized by the thread penetration process may be reinforced by a heat treatment if the mats are pre-impregnated. In this manner loops may be formed without the eye of the needle passing entirely through the fabric.

It is a further advantage of the invention that the knotting process is omitted, and further, a gripper is not needed which results in a more gentle handling of the thread, since only the needed thread portion runs through the eye. In contrast, in a backstitch seam process, for forming each loop, substantial thread lengths are to be pulled through the eye to permit a gripper to lead the formed loop around a bobbin capsule. Therefore, the gripper pulls a thread length through the eye and the thread length is again pulled back through the eye when the upper thread is pulled tight (knotted). Consequently, in the conventional sewing process thread length portions pass repeatedly through the eye after they eventually come to rest as a portion of the seam. The needle according to the invention avoids such a stress on the thread.

In addition, the needle according to the invention has a stable construction; no hollow wedge for a gripper is required. Accordingly, an inherent weakening of the cross section of the needle is also absent.

According to an advantageous feature of the invention the bore which forms the eye has a circular cross section. The eye bore extends through the needle body with an acute angle to the longitudinal blade axis and is thus relatively long. The circular cross section of the eye bore results in a very satisfactory thread guidance and the thread is stabilized.

If the needle eye is oriented at a very small (acute) angle to the longitudinal needle axis, the needle according to the invention is particularly well adapted for introducing the thread into the fabric and for forming a loop which, upon withdrawal of the needle, is maintained ideally in its full configuration. If in such a construction the inlet and the outlet of the eye are offset relative to one another as viewed transversely to the longitudinal blade axis, so that, when viewed from the side, the inlet and the outlet of the needle do not intersect (that is, a positive axial distance remains between the inlet and the outlet of the eye), the thread is guided in a very satisfactory manner and runs with low friction through the needle eye. In this manner, an entrainment of the thread during the return stroke of the needle is avoided.

The eye is preferably cylindrical which also serves the above-described purpose. The thread guidance is furthermore enhanced by a possibly large eye length which, when measured parallel to the longitudinal needle axis, is preferably greater than the thickness of the needle.

A trough provided on the needle blade and leading to the eye enhances the guidance of the thread and makes possible an almost frictionless introduction of the thread into the fabric if the depth of the trough is approximately equal to or greater than the diameter of the eye. The thread trough may have a rectangular, square or other cross-sectional shape.

At the side oriented away from the thread trough, the eye is at its inlet bordered by an edge which is slightly rounded and is arranged at the outer side of the needle. The edge serves for guiding the thread during the return stroke of the needle and is effective in avoiding friction between the thread and the fabric. As a result, an entrainment of the thread by the needle during its return stroke is prevented.

The acute angle at which the eye is inclined with respect to the needle axis is preferably smaller than 30° or even less than 20° or 15°.

It is furthermore expedient to set the distance between the needle point and the eye such that it is smaller than the length of the eye. The relatively large eye length results in a very satisfactory thread guidance and the relatively small distance between the needle point and the eye outlet results in a large penetration depth of the thread. This applies particularly when the distance between the needle point and the eye outlet is less than one-half of the eye length.

The protuberance provided in the vicinity of the outlet of the eye, serving for firmly clamping the thread in or at the fabric, has a height which is preferably approximately 80% of the eye diameter. This results in a very satisfactory clamping of the thread in the penetration hole without an excessive increase of friction. Furthermore, a small penetration hole is obtained as compared to a hollow needle. This feature is of particular advantage, for example for stitching (stabilizing) carbon fiber mats.

Advantageously, the protuberance is relatively short as viewed in a direction parallel to the needle length; it is preferably shorter than 80% of the eye length.

Between the protuberance and the eye preferably a rounded transition is formed to thus handle delicate threads in a gentle manner. In particular, Keel threads may be introduced into the fabric without damage.

A needle blade which is long, linear and has substantially a constant cross section permits the introduction of threads even into thick fabric layers. For example, by means of the needle according to the invention several layers of materials may be fixed to one another by thread penetration while the layers need not be pierced through.

DESCRIPTION OF THE PREFERRED EMBODIMENT

Figures 1, 2:
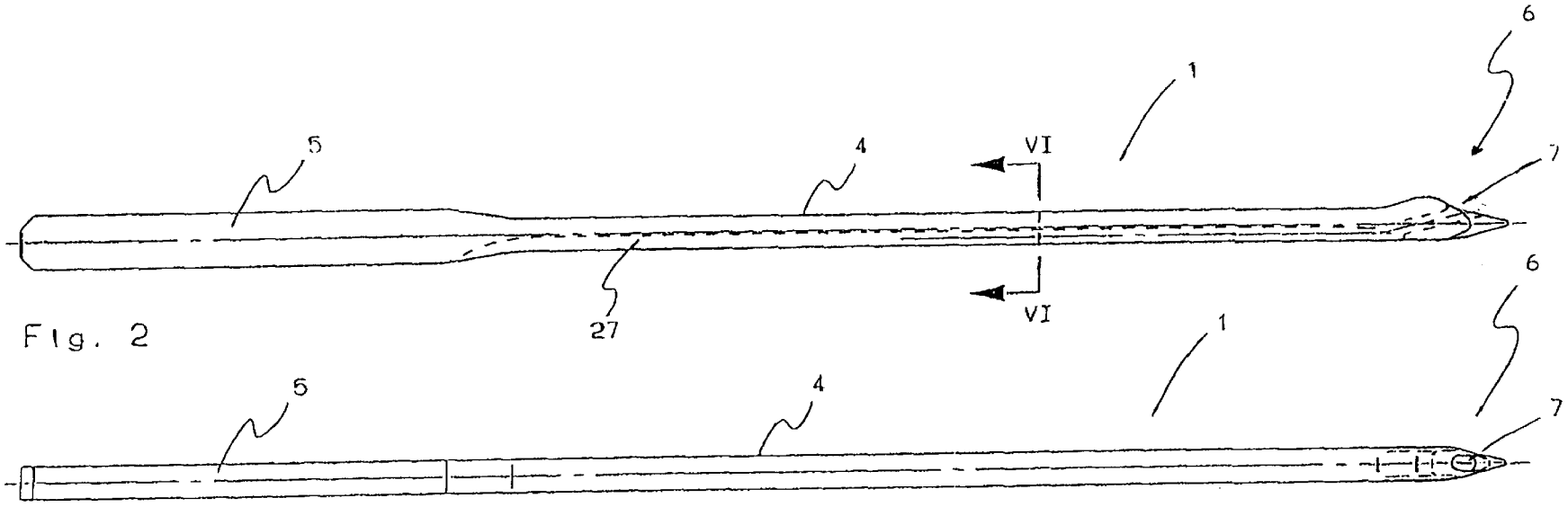
FIG. 1 is top plan view of a preferred embodiment of the needle according to the invention.
FIG. 2 is a side elevational view of the preferred embodiment.

FIGS. 1 and 2 illustrate a needle 1 for pushing a thread 2 into a fabric 3 as illustrated in the sequential FIGS. 7–12. The needle 1 has a blade 4 adjoined at one end by a shank 5 and by a head 6 at its opposite end. The needle head 6 is provided with an eye 7 having a length L.

Figure 3:
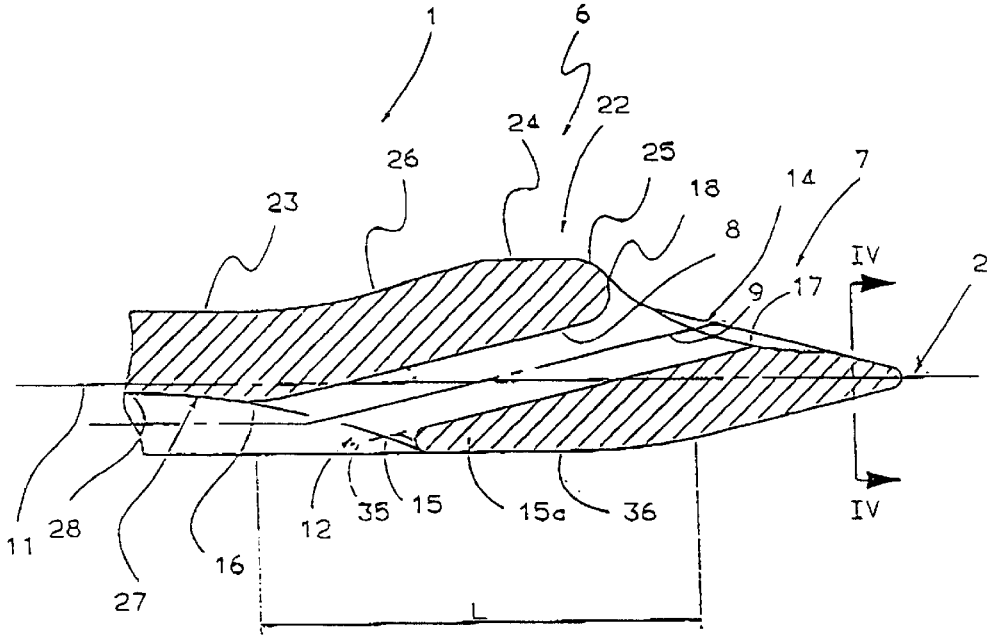
FIG. 3 is an enlarged sectional side elevational view of the needle point region of the preferred embodiment.

Also referring to the FIG. 3, the eye 7 is formed by a cylindrical bore 8 whose central bore axis 9 is oriented at an acute angle of approximately 13° to a longitudinal central axis 11 of the needle 1. The axis 11 defines the orientation of the length dimension of the blade 4. The eye 7 has an inlet 12 and an outlet 14. The inlet 12 is bounded with respect to the longitudinal direction of the needle 1 by an edge 15 which is close to the needle point and an edge 16 which is remote therefrom. Between the bore 8 and the needle side 36 which adjoins a thread trough 27, a needle region 15*a* is obtained whose cross section increases from the edge 15 towards the needle point 21. An imaginary line which prolongs the bore 8 and which touches the edge is forms an imaginary point of intersection 35 with the needle side 36. The distance between the point of intersection 35 and the bottom 28 of the needle trough 27 is greater than the diameter of the bore 8.

The outlet 14 of the eye 7 is bounded by an edge 17 which is close to the needle point 21 and an edge 18 which is remote therefrom. The inlet 12 and the outlet 14 are spaced from one another with respect to the needle axis 11, that is, between the edge 15 and the edge 18 a positive distance is provided. Stated differently, the inlet 12 and the outlet 14 are offset with respect to one another relative to the needle axis 11.

Figure 4:
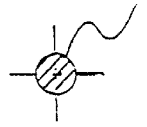
FIG. 4 is a sectional view taken along line IV—IV of FIG. 3.
Figure 5:
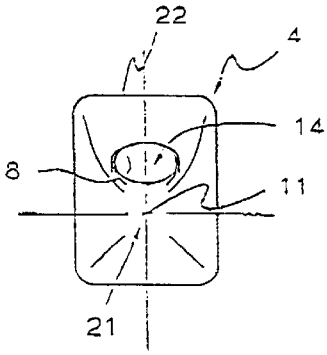
FIG. 5 is a front elevational view of the preferred embodiment.

The needle head 6 begins to taper approximately in the region of the eye outlet 14 to eventually form a point 21. In the vicinity of the point 21 the needle 1 has a circular cross section as shown in FIG. 4. The point 21 determines the position of the longitudinal axis 11. The edge 17 of the outlet 14 and the edge 16 of the inlet 12 are situated on different sides of the needle axis 11. Despite its small inclination to the needle axis 11, the bore 8 extends entirely from one side of the axis 11 to the other.

The bore 8 has a circular cross section and is cylindrical. The distance between the edge 17 of the outlet 14 and the point 21 is preferably at the most as large as the thickness of the needle and is thus significantly shorter than the length of the bore 8.

At its edge 18 the bore 8 is adjoined, with a rounding, by a protuberance 22 which rises from the back 23 of the needle blade 4. The back 23 constitutes an outermost surface of the needle blade 4. The height of the protuberance 22 is preferably approximately 80% of the diameter of the bore 8.

The protuberance 22 has a preferably short planar plateau 24 adjoined, with a rounding, by a region 25 which is inclined to the central longitudinal axis 11 and which adjoins the eye 7. At its end remote from the eye 7, the plateau 24 of the protuberance 22 is adjoined by a region 26 which is inclined to the needle axis 11. The transitions are rounded in each instance.

Figure 6:
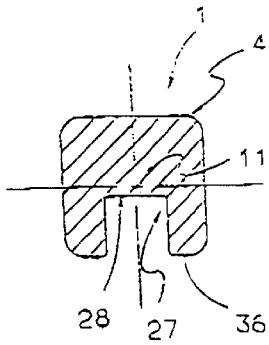
FIG. 6 is an enlarged sectional view taken along line VI—VI of FIG. 2.

In the blade side opposite the protuberance 22, as shown in FIGS. 2 and 3, a thread trough 27 is formed which extends from the shank 5 to the inlet 12 of the eye 7. The thread trough 27 has, as shown in FIG. 6, an approximately square cross-sectional configuration. The depth of the thread trough 27 extends almost to the central longitudinal axis 11 of the blade 4 which also has preferably an essentially square cross-sectional outline. The blade cross section is approximately rectangular only in the region of the protuberance 22; the corners, that is, the longitudinal edges of the blade 4 are throughout rounded.

In the description which follows, the sewing operation of the above-described sewing needle 1 will be described.

Figures 7, 8, 9:
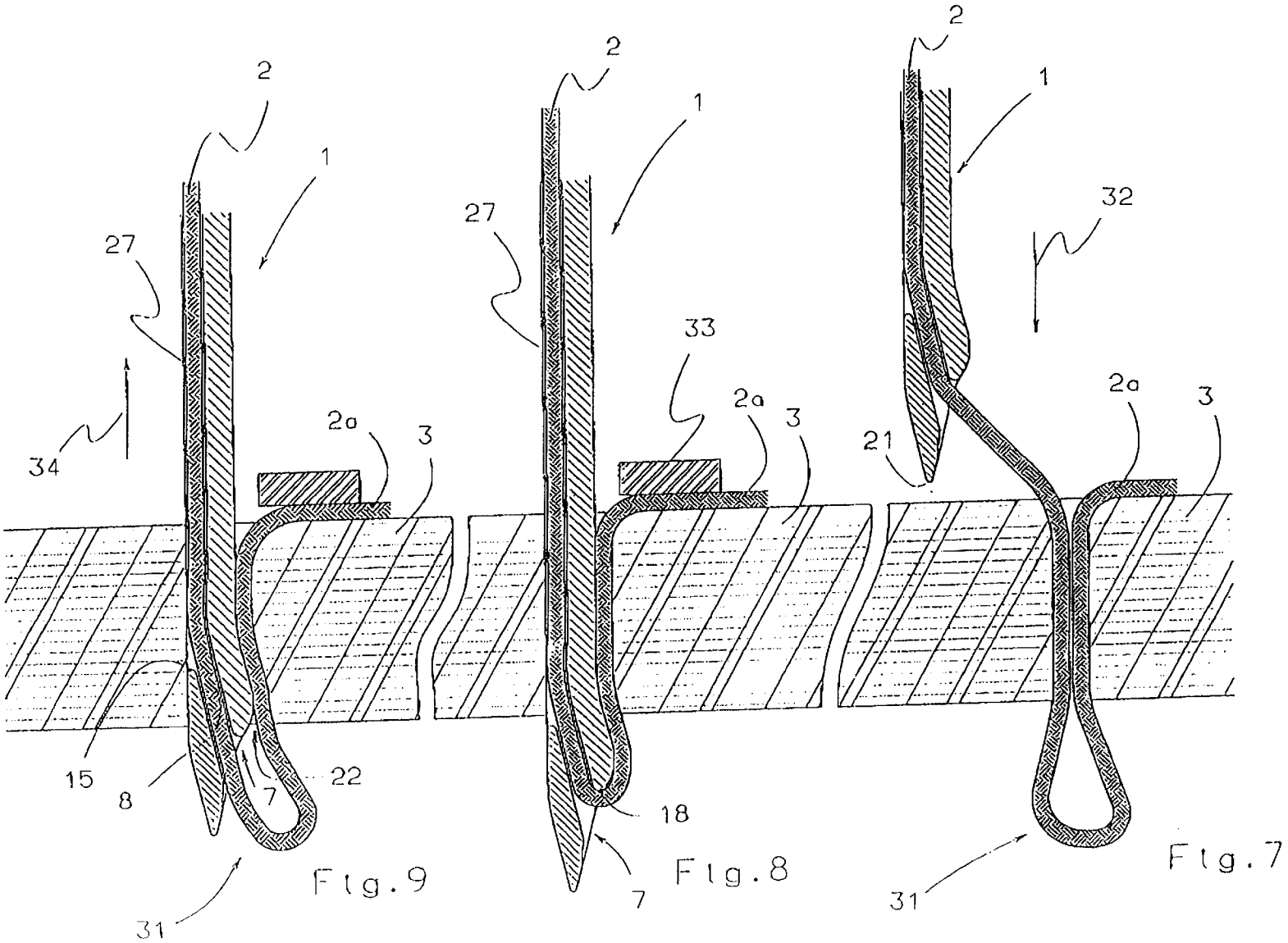
FIG. 7 is a sectional side elevational view of a needle according to the invention depicted after completing a through-piercing process and before the beginning of the successive penetrating process.
FIG. 8 is a sectional side elevational view of the needle during the penetration of the thread into and through the fabric before reaching its lower dead center.
FIG. 9 is a sectional side elevational view of the needle depicted during its return stroke.

FIGS. 7, 8 and 9 illustrate different operational stages of the penetration of the thread 2 through the fabric 3.

FIG. 7 shows a completed loop 31 in the fabric 3 which may be formed, for example, by several layers of superposed carbon fiber mats. The needle 1 has moved one step further along the fabric 3 and is lowered in the direction of the arrow 32 towards the fabric 3. The needle 1 forms a penetration hole in the fabric 3.

As shown in FIG. 8, the needle 1 has pierced through the fabric 3, and the thread 2*a* lying on the fabric 3 is immobilized by a holder 33. As the needle 1 moves downward, the eye 7, by means of the rounded edge 18, pulls the thread 2 through the opened penetration hole, while the thread 2 runs with low friction in the thread trough 27. The protuberance 22 too, immobilizes the thread 2 against the fabric 3 and prevents the already inserted thread 2*a*, lying on the fabric 3, from being pulled out.

During the return stroke of the needle 1 in the direction shown by the arrow 34 in FIG. 9, the protuberance 22 presses the thread 2 against the wall of the penetration hole, that is, against the fabric 3. The loop 31 thus remains freely standing underneath the fabric 3. The thread lies without play in the eye 7 and the thread trough 27. It runs essentially taut through the eye 7 and while doing so, the round bore 8 which is inclined in the direction of thread advance, lends the thread a certain stability. The edge 15 moves the thread 2 in the direction of the eye 7 and prevents a contact between the thread 2 and the fabric 3 which provides for the loop formation of the needle 1 according to the invention. The low friction between the thread and the round eye inclined in the direction of thread advance additionally enhances formation of the loop. No gripper is needed which would immobilize the loop 31 and would wind it about a bobbin capsule. In this manner during penetration the required thread length is completely pulled from a bobbin, and the thread length forming the loop 31 runs through the eye 7 only once. When the loop 31 is completed, several fabric layers are stabilized. Thus, the needle according to the invention makes possible a controlled loop formation.

Figures 10, 11, 12:
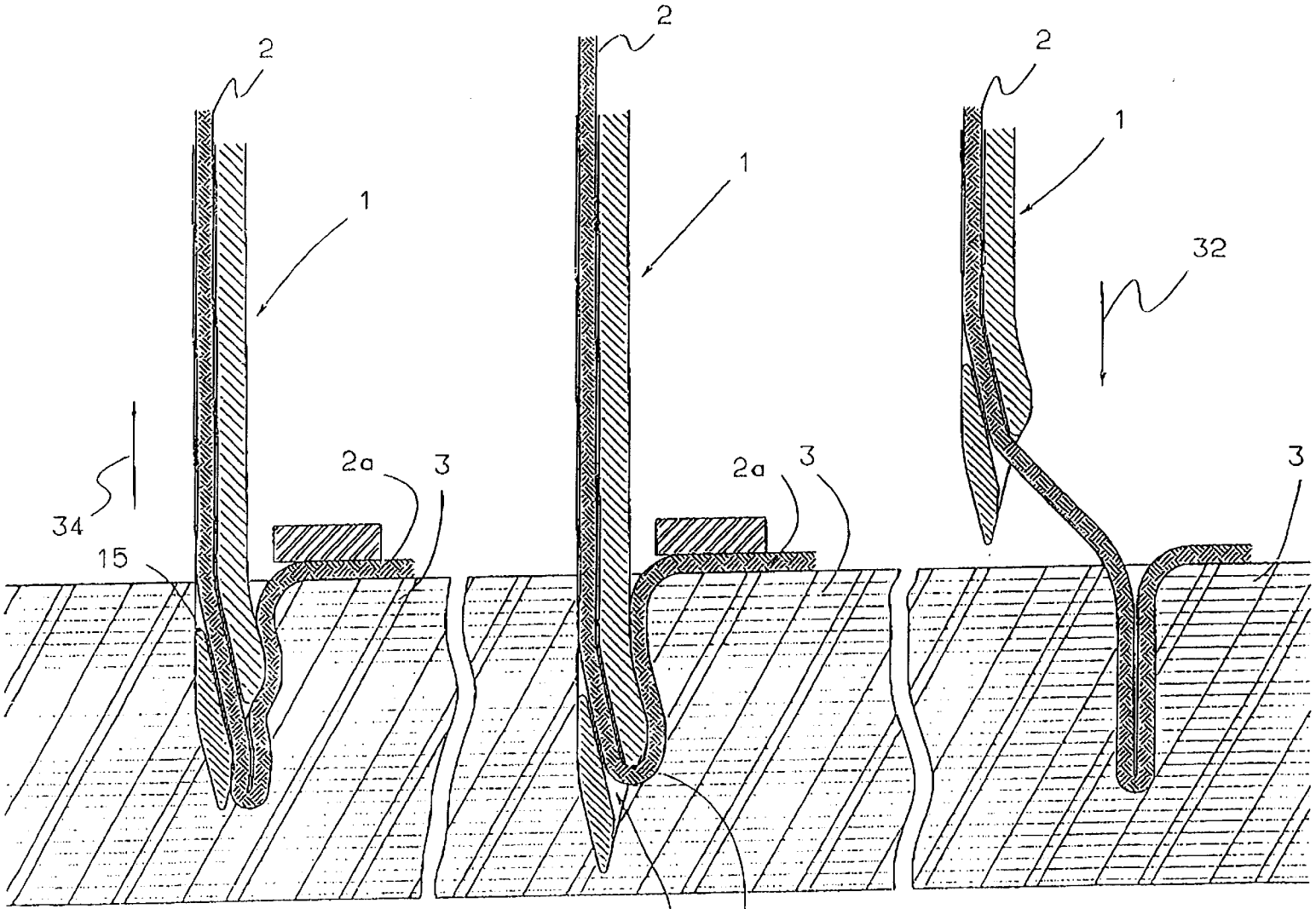
FIG. 10 is a sectional side elevational view of the needle depicted after the penetration of a thread into the fabric, depicted immediately prior to the successive penetration process.
FIG. 11 is a sectional side elevational view of the needle during penetration of a thread into the fabric, depicted before reaching its lower dead center.
FIG. 12 is a sectional side elevational view of the needle during the penetration of a thread into the fabric, depicted during the return stroke of the needle.

FIGS. 10, 11 and 12 illustrate the introduction of a thread 2 into a thicker fabric 3 which is not pierced through by the needle 1. In other aspects the thread-introducing process corresponds substantially to that described previously, except that no loops are formed underneath the fabric 3. Rather, the introduced thread 2 remains "stuck" in the penetration hole. This condition is illustrated in FIG. 10 for a previously performed thread introducing process. In FIG. 10 the needle 1 begins a new penetration process in the direction of the arrow 32. This process is shown in its further development in FIG. 11. As seen, the eye 7 pulls the thread 2 into the fabric 3 by means of the rounded edge 18. During the return stroke according to FIG. 12 in the direction of the arrow 34, the thread 2 remains in the penetration hole while it is held frictionally therein. The comparatively lower friction between the thread 2 and the needle 1 ensures that the needle 1 is pulled out of the pierced hole in the direction of the arrow 34 without entwining the thread 2.

It will be understood that the above description of the present invention is susceptible to various modifications, changes and adaptations, and the same are intended to be comprehended within the meaning and range of equivalents of the appended claims.

What is claimed is:

1. A needle for introducing a thread into a fabric, comprising (a) an elongated needle blade having a longitudinal axis and an outermost needle blade surface;

(b) a needle point;

(c) an eye traversing said needle blade at an acute angle to said longitudinal axis; said eye having an inlet and an outlet situated on opposite sides of said needle blade; and (d) a protuberance formed on said needle blade; said protuberance adjoining said outlet and projecting laterally outward from said outermost needle blade surface.

2. The needle as defined in claim 1, wherein said inlet has a first bordering edge and a second bordering edge; said first bordering edge being closer to said needle point than said second bordering edge; further wherein said outlet has a third bordering edge and a fourth bordering edge; said third bordering edge being closer to said needle point than said fourth bordering edge; said first and fourth bordering edges being spaced from one another as viewed parallel to said longitudinal axis.

3. The needle as defined in claim 1, wherein said eye has a circular cross section.

4. The needle as defined in claim 3, wherein said inlet has a first bordering edge and a second bordering edge; said first bordering edge being closer to said needle point than said second bordering edge; further wherein said outlet has a third bordering edge and a fourth bordering edge; said third bordering edge being closer to said needle point than said fourth bordering edge; said first and fourth bordering edges being spaced from one another as viewed parallel to said longitudinal axis.

5. The needle as defined in claim 1, wherein said eye is cylindrical.

6. The needle as defined in claim 1, wherein said needle blade has a thickness and said eye has a length; said length being greater than said thickness.

7. The needle as defined in claim 1, further comprising a thread trough provided in said needle blade and extending to said eye; said thread trough being oriented parallel to said longitudinal axis.

8. The needle as defined in claim 7, wherein said eye has a diameter and said thread trough has a depth; said depth being essentially identical to said diameter.

9. The needle as defined in claim 7, wherein said thread through has an essentially rectangular cross-sectional shape.

10. The needle as defined in claim 7, wherein said thread through has a quadratic cross-sectional shape.

11. The needle as defined in claim 1, wherein said inlet has a first bordering edge and a second bordering edge; said first bordering edge being closer to said needle point than said second bordering edge; further wherein said first bordering edge is situated at an outer side of said needle blade.

12. The needle as defined in claim 11, wherein said eye is formed by a bore having a bore axis and a bore diameter; further comprising a thread trough provided in a side of said needle blade and extending to said eye; said thread trough having a length being oriented parallel to said longitudinal axis; further wherein an imaginary line prolonging said bore and touching said first bordering edge intersects said side of said blade at a point of intersection whose distance from a bottom of said thread trough is greater than said bore diameter.

13. The needle as defined in claim 1, wherein said eye is formed by a bore having a central bore axis; and further wherein said acute angle is formed between said blade axis and said bore axis and is less than 30°.

14. The needle as defined in claim 1, wherein said eye is formed by a bore having a central bore axis; and further wherein said acute angle is formed between said blade axis and said bore axis and is less than 20°.

15. The needle as defined in claim 1, wherein said eye is formed by a bore having a central bore axis; and further wherein said acute angle is formed between said blade axis and said bore axis and is less than 15°.

16. The needle as defined in claim 1, wherein a distance between said needle point and said eye is less than a length of said eye.

17. The needle as defined in claim 1, wherein a distance between said needle point and said eye is less than one half of a length of said eye.

18. The needle as defined in claim 17, wherein a distance between said needle point and said eye is less than a thickness of said blade.

19. The needle as defined in claim 1, wherein a distance between said needle point and said eye is less than a thickness of said blade.

20. The needle as defined in claim 1, wherein said blade axis passes through said needle point; and further wherein said inlet and said outlet are in their entirety at opposite sides of said blade axis.

21. The needle as defined in claim 1, wherein said protuberance has a height measured perpendicularly to said blade axis; said height being less than 80% of a diameter of said eye.

22. The needle as defined in claim 1, wherein said protuberance has a length measured parallel to said blade axis; said length being less than 80% of a length of said eye.

23. The needle as defined in claim 1, further comprising a rounded transition between said protuberance and said eye.

24. The needle as defined in claim 1, wherein said needle blade is linear; and further wherein said needle blade has a length portion which adjoins said protuberance and which has a constant cross section; said length portion being a multiple of a length of said eye.

25. The needle as defined in claim 1, wherein said needle blade has one of a rectangular and square cross section.

* * * * *